US006966148B2

(12) United States Patent
Choi

(10) Patent No.: US 6,966,148 B2
(45) Date of Patent: Nov. 22, 2005

(54) WINDOW GLASS INTERLOCK DEVICE FOR VEHICLE SLIDING DOOR

(75) Inventor: Jae-Hong Choi, Gyeonggi-do (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 10/750,674

(22) Filed: Dec. 31, 2003

(65) Prior Publication Data

US 2005/0081449 A1 Apr. 21, 2005

(30) Foreign Application Priority Data

Oct. 20, 2003 (KR) ..... 10-2003-0072937

(51) Int. Cl.[7] ..... E05F 11/54
(52) U.S. Cl. ..... 49/360; 49/349; 296/155
(58) Field of Search ..... 49/352, 349, 348, 49/360; 296/155

(56) References Cited

U.S. PATENT DOCUMENTS 1,746,442 A * 2/1930 Piper ..... 16/200
4,381,625 A * 5/1983 Andrei-Alexandru et al. 49/280
4,478,004 A * 10/1984 Andrei-Alexandru et al. . 49/72
4,554,763 A * 11/1985 Dauvergne ..... 49/349
4,640,050 A * 2/1987 Yamagishi et al. ..... 49/280
5,829,198 A 11/1998 Watanabe
6,053,271 A * 4/2000 Lee ..... 180/282
6,412,222 B1 * 7/2002 Hashiba et al. ..... 49/168
6,477,806 B1 * 11/2002 Asada et al. ..... 49/169
6,513,285 B2 * 2/2003 Isomura ..... 49/351
6,659,539 B2 * 12/2003 Yogo et al. ..... 296/155
2004/0168371 A1 * 9/2004 Engelgau et al. ..... 49/280

FOREIGN PATENT DOCUMENTS

JP 2000-136664 5/2000

* cited by examiner

*Primary Examiner*—Gregory J. Strimbu
(74) *Attorney, Agent, or Firm*—Morgan Lewis & Bockius LLP

(57) ABSTRACT

A window glass interlock device for a vehicle sliding door adapted to limit the opening of the sliding door when the window glass exceeds a prescribed opening degree, thereby preventing jamming of a passenger's body part between the sliding door and the vehicle body and minimizing injury to the passenger.

5 Claims, 6 Drawing Sheets

WINDOW GLASS INTERLOCK DEVICE FOR VEHICLE SLIDING DOOR

CROSS-REFERENCE TO RELATED APPLICATIONS

This application claims priority of Korean Application No. 10-2003-0072937, filed on Oct. 20, 2003, the disclosure of which is incorporated fully herein by reference.

FIELD OF THE INVENTION

The present invention provides a window glass interlock device for a vehicle sliding door adapted to limit the opening of a sliding door when the window glass is excessively opened to a certain degree in the event a passenger's body part is exposed through the open window glass.

BACKGROUND OF THE INVENTION

In a sliding door mounted with a window glass that can open, a passenger's head or arm is susceptible to being exposed outside the vehicle. If the passenger's body is partially exposed outside the window glass while the sliding door is opened, a passenger's body part is susceptible to being jammed between the vehicle body and the sliding door, causing injury to the passenger.

SUMMARY OF THE INVENTION

Embodiments of the present invention provide a window glass interlock device for a vehicle sliding door adapted to limit the opening of a sliding door when the window glass of the sliding door is opened excessively to a certain degree, thereby preventing injury to the body of a passenger exposed outside through the open glass.

In a preferred embodiment of the present invention, the window glass interlock device for a vehicle sliding door comprises a guide rail fixed at a sliding door. A window glass carrier linearly slides up and down along the guide rail for ascending and descending a window glass. A detecting guide is integrally fixed at the window glass carrier. A detecting lever is fixed in relation to the sliding door for allowing the detecting guide to contact and pivot the detecting lever by the ascending and descending movement. An interlock lever is pivotally installed in relation to the sliding door. A cable connects the detecting lever and the interlock lever for allowing the interlock lever to pivot by the pivot of the detecting lever. A stop block is fixed at the vehicle body for restricting the amount of the opening of the sliding door by blocking the interlock lever. A spring is installed to allow the interlock lever to pivot in a state that the interlock lever may be blocked by the stop block when the detecting guide is distant from the detecting lever.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

The preferred embodiment of the present invention will now be described in detail with reference to the accompanying drawings.

Figure 1:
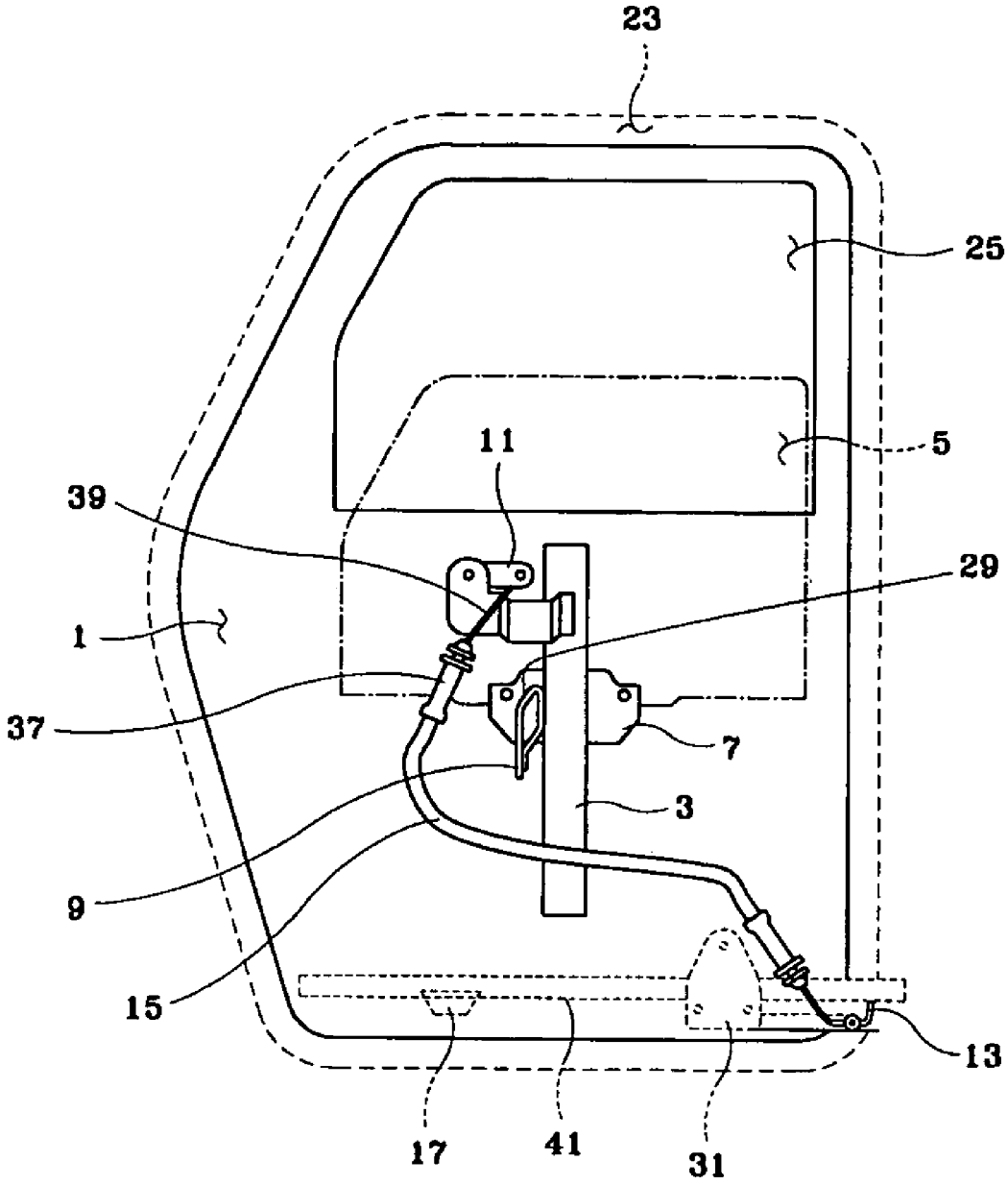
FIG. 1 illustrates a structure of a window glass interlock device for a vehicle sliding door according to an embodiment of the present invention.
Figure 2:
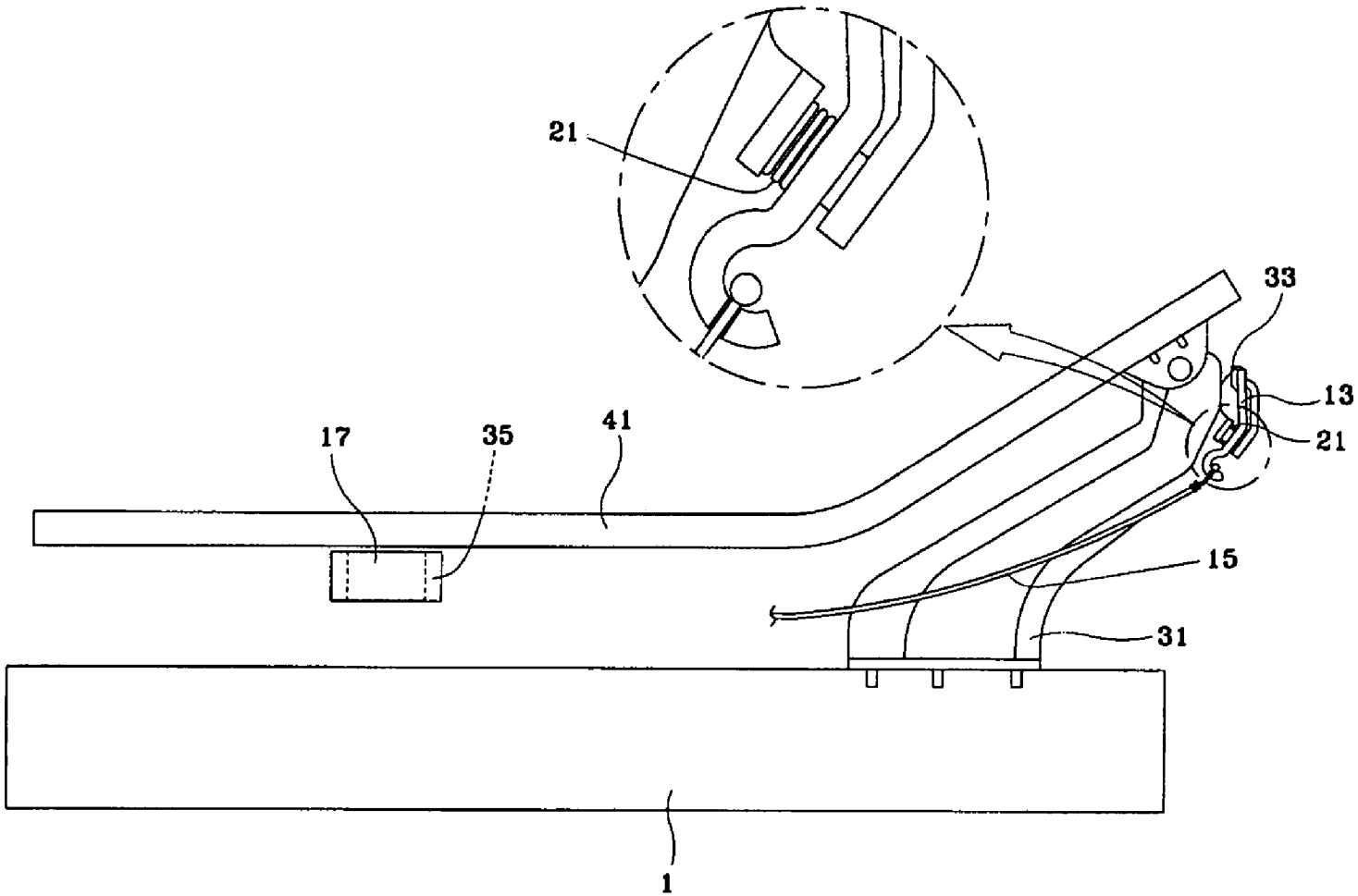
FIG. 2 is a top view of FIG. 1 illustrating the relationship of a low roller rail, sliding door, and interlock lever.

As shown in FIGS. 1 and 2, a window glass interlock device for a vehicle sliding door according to an embodiment of the present invention comprises a guide rail 3 fixed at a sliding door 1. A window glass carrier 7 linearly slides up and down along the guide rail 3 for ascending and descending a window glass 5. A detecting guide 9 is integrally fixed at the window glass carrier 7. A detecting lever 11 is fixed in relation to the sliding door 1 for allowing the detecting guide 9 to contact and pivot the detecting lever 11 by the ascending and descending movement. An interlock lever 13 is pivotally installed in relation to the sliding door 1. A cable 15 connects the detecting lever 11 and the interlock lever 13 for allowing the interlock lever 13 to pivot by the pivot of the detecting lever 11. A stop block 17 is fixed at a vehicle body 19 (see FIG. 7) for restricting the amount of the opening of the sliding door 1 by blocking the interlock lever 13. A spring 21 is installed to allow the interlock lever 13 to pivot in a state that the interlock lever 13 may be blocked by the stop block 17 when the detecting guide 9 is distant from the detecting lever 11.

The sliding door 1 disposed at the side of the vehicle is installed to slide forward and backward in relation to the vehicle and to open and close a door opening 23 formed at the side of the vehicle.

The sliding door 1 is formed with a window glass opening 25 opened and closed by the window glass 5. The window glass opening 25 is opened and closed via the window glass 5 supported by the window glass carrier 7 ascending and descending along the guide rail 3. The window glass carrier 7 ascends and descends along the guide rail 3 by a window regulator (not shown) in the conventional method.

In the embodiment of the present invention, when the window glass 5 is opened 80 mm or more (when the window glass 5 descends in the glass opening 25), the opening of the sliding door 1 is restricted via the stop block 17 and the interlock lever 13. Hereinafter, when the window glass 5 is opened less than 80 mm, it will be referred to as "opening of the window glass according to a safe zone," and if the window glass 5 is opened 80 mm or more, it will be referred to as "opening of the window glass according to an unsafe zone."

The 80 mm described above is the minimum length for allowing a head of the passenger to be exposed outside through the window glass opening 25. However, the window glass 5 is not limited to being opened 80 mm but can be adjusted in the design step.

The detecting lever 11 is fixed as a hinge at a support bracket 27 secured at one end to the guide rail 3. Thus, the detecting lever 11 is fixed in relation to the sliding door 1. The detecting guide 9 is formed at an upper portion with a round part 29, that has a smooth curved shape contacting the detecting lever 11. Accordingly, when the detecting guide 9 moves up and contacts the detecting lever 11 via the smooth curved round part 29, the detecting lever 11 can smoothly be pivoted according to the ascent of the detecting guide 9.

Figure 8:
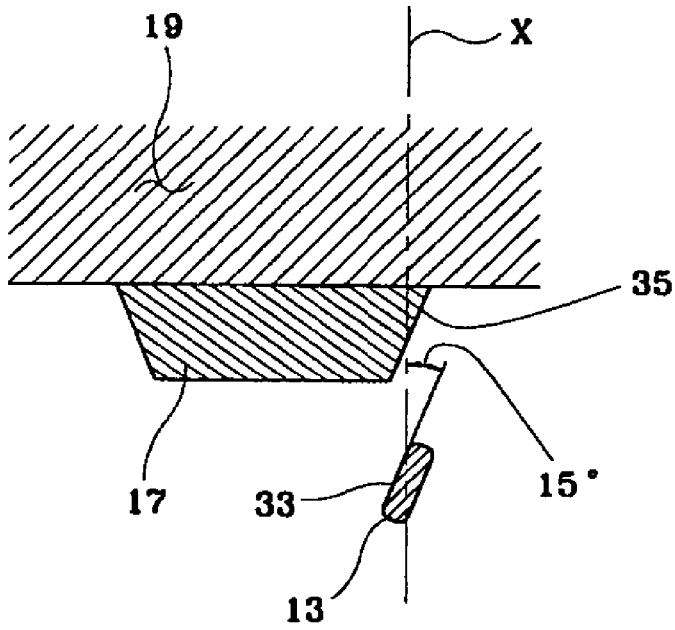
FIG. 8 illustrates a movement of an interlock lever when a window glass is closed according to a safe zone from the state of FIG. 7.

The interlock lever 13 is fixed as a hinge to a guide bracket 31 mounted at a lower side of the sliding door 1. Thus, the interlock lever 13 is pivotally installed to the sliding door 1. The guide bracket 31 is a conventional component and installed at a lower side of the sliding door 1 for sliding along a low roller rail 41 and guiding the opening and closing of the sliding door 1. A contact portion of the interlock lever 13 to the stop block 17 is formed with a slant lever side 33 inclined in relation to a vertical plane. The stop block 17 is formed with a slant block side 35 parallel with the slant lever side 33. In the embodiment of the present invention, the slant lever side 33 and the slant block side 35 are formed in a 15° incline in relation to a vertical plane (X) (see FIG. 8). The cable 15 is composed of an outer cover 37 and an inner cable 39. The outer cover 37 is fixed at the sliding door 1, and when the detecting lever 11 pivots, only the inner cable 39 is pulled or released. The spring 21 is a torsion spring installed between the guide bracket 31 and the interlock lever 13.

The operation of the embodiment of the present invention constructed above will now be described.

Figure 6:
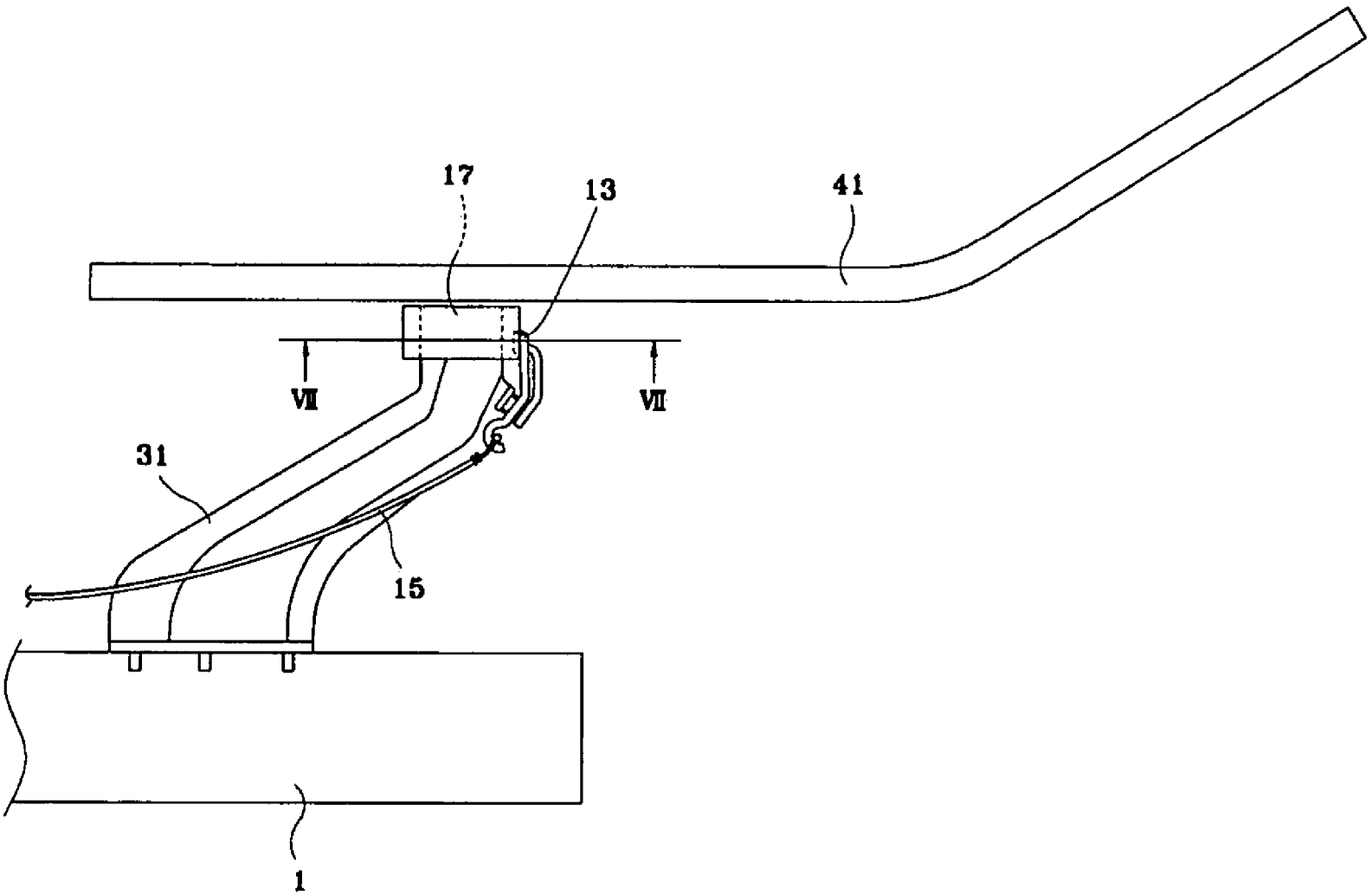
FIG. 6 illustrates the opening state of a sliding door when a window glass is opened according to an unsafe zone.

FIG. 1 illustrates the window glass 5 opened according to an unsafe zone, and the detecting guide 9 is distantly positioned from the detecting lever 11. Further, the slant lever side 33 of the interlock lever 13 is pivoted to an upper side via the elastic force of the torsion spring 21 (see FIG. 4). Accordingly, if the interlock lever 13 is blocked by the stop block 17 during the sliding door 1 opening as shown in FIG. 6, the sliding door 1 will be limited in opening (see FIG. 7).

Figure 3:
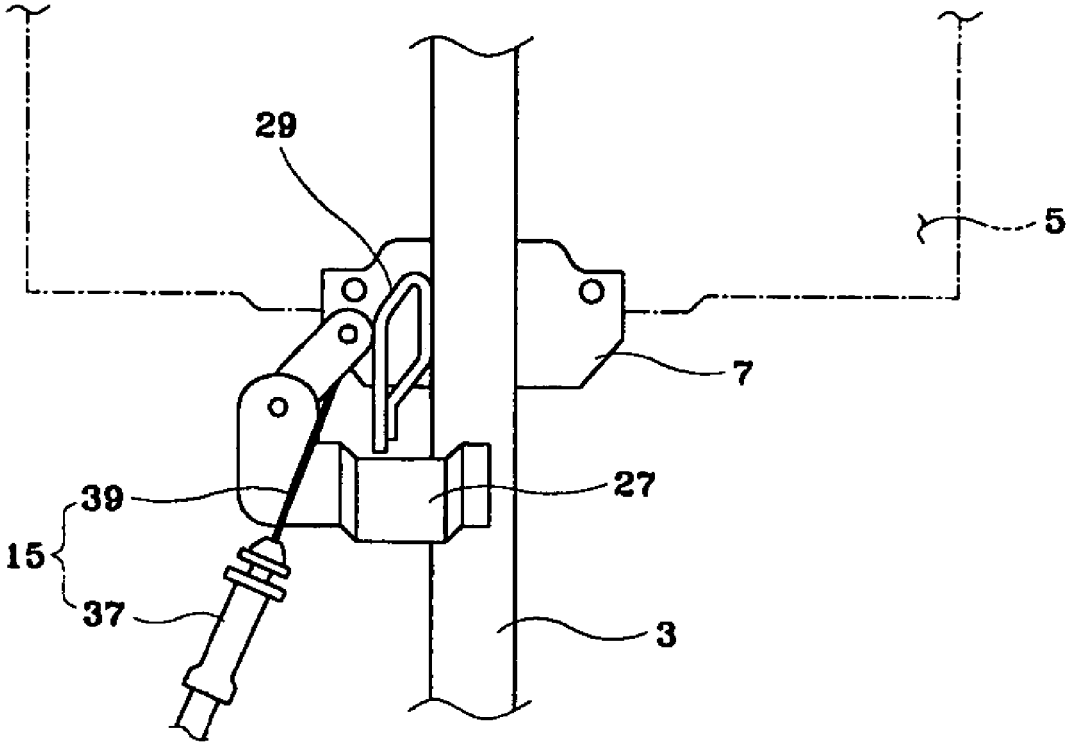
FIG. 3 illustrates a detecting guide and a detecting lever when a window glass is opened according to a safe zone.

The stop block 17 should properly be installed to enable to protect a passenger's body partially exposed through the window glass opening 25 by stopping the opening of the sliding door 1. If the sliding door 1 stops opening, injury to a passenger's body exposed through the window glass opening 25 is minimized. When the window glass 5 is in a safe zone, the detecting guide 9 renders the detecting lever 11 to pivot to an upper side (see FIG. 3).

Figure 4:
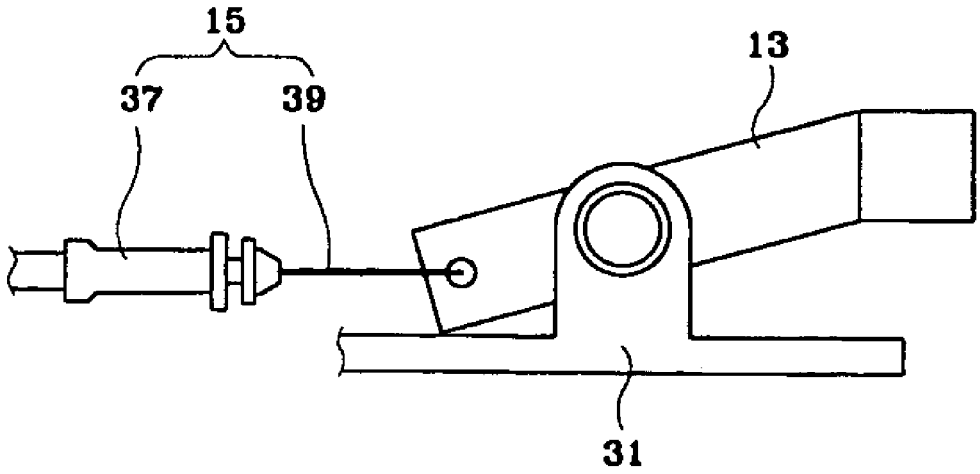
FIG. 4 illustrates the state of an interlock lever when a window glass is opened according to an unsafe zone.
Figure 5:
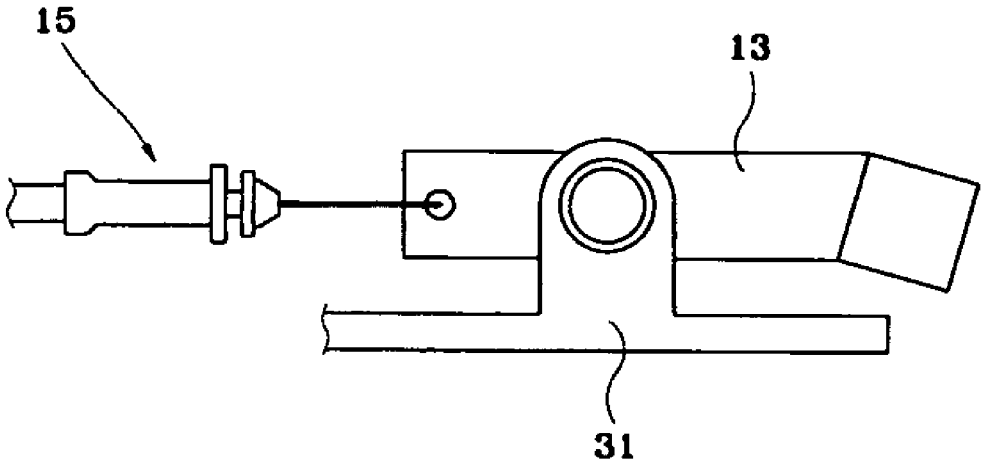
FIG. 5 illustrates the state of an interlock lever when a window glass is opened according to a safe zone.

Provided that the detecting lever 11 is pivoted to an upper side, the inner cable 39 of the cable 15 is also pulled toward the upper side, and the interlock lever 13 overcomes the elastic force of the torsion spring 21 for being pivoted as shown in the states from FIG. 4 to FIG. 5. If the window glass 5 is opened according to a safe zone, the interlock lever 13 is not blocked by the stop block 17. In short, the sliding door 1 can completely open the door opening 23.

Figure 7:
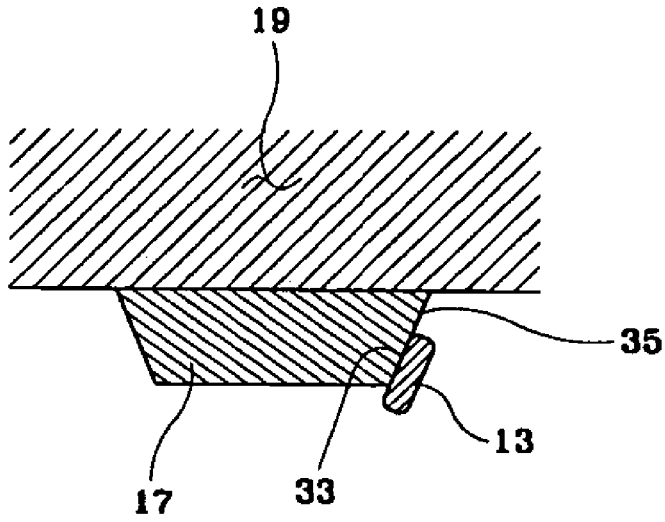
FIG. 7 is a cross-sectional view of VII—VII of FIG. 6.

On the other hand, if the window glass 5 is opened according to an unsafe zone, the sliding door 1 is prevented from being opened via the interlock lever 13 blocked by the stop block 17 as shown in FIG. 7. However, once the window glass 5 ascends and the detecting lever 11 pivots by the ascent of the detecting guide 9, the interlock lever 13 pivots as shown in FIG. 5. The sliding door 1 can now completely open the door opening 23. When the interlock lever 13 is blocked by the stop block 17 and then released, the disposition of the slant lever side 33 of the interlock lever 13 changes from the states of FIG. 7 to FIG. 8.

Accordingly, the slant lever side 33 is separated from the slant block side 35 without surface friction. Further, a large friction is prevented between the interlock lever 13 and the stop block 17.

When a vehicle stops on a descending slope and the interlock lever 13 is blocked by the stop block 17 during the opening of the sliding door 1, the weight of the sliding door 1 applies to the stop block 17 via the interlock lever 13. In order for the interlock lever 13 to be separated from the stop block 17, the window glass 5 ascends and the interlock lever 13 should be pivoted by overcoming friction applied between the slant lever side 33 and the slant block side 35.

In the embodiment of the present invention, the interlock lever 13 can be pivoted without large friction between the interlock lever 13 and the stop block 17 via the slant lever side 33 and the slant block side 35, therefore, the window glass 5 can smoothly ascend and descend without overloading the window regulator.

As apparent from the foregoing, there is an advantage in the present invention, in that the sliding door is limited in opening when the window glass exceeds a prescribed opening degree, thereby preventing a passenger's body part from being jammed between the sliding door and the vehicle body and minimizing injury to the passenger.

What is claimed is:

1. A window glass interlock device comprising:

a guide rail fixed at a sliding door;

a window glass carrier linearly sliding up and down along said guide rail for ascending and descending a window glass;

a detecting guide integrally fixed at said window glass carrier;

a detecting lever fixed in relation to said sliding door for allowing said detecting guide to contact and pivot said detecting lever in response to the ascending movement of said window glass carrier;

an interlock lever pivotally installed in relation to said sliding door;

a cable connecting said detecting lever and said interlock lever for allowing said interlock lever to pivot in response to the pivoting of said detecting lever;

a stop block restricting the amount of opening of said sliding door by blocking said interlock lever; and a spring installed to bias said interlock lever to pivot into a position such that said interlock lever is blocked by said stop block when said detecting guide is distant from said detecting lever;

wherein a portion of said interlock lever that contacts said stop block is formed with a slant lever side inclined vertically in relation to a vertical plane; and said stop block is formed with a slant block side parallel with said slant lever side.

2. The device of claim 1, wherein said detecting lever is attached via a hinge to a support bracket secured at one end to said guide rail.

3. The device of claim 1, wherein said detecting guide is formed with a round part at an upper portion thereof that contacts said detecting lever only when said window glass carrier is raised.

4. The device of claim 1, wherein said interlock lever is fixed via a hinge to a guide bracket mounted at a lower side of said sliding door.

5. The device of claim 1, wherein said slant lever side and said slant block side are inclined 15° in relation to said vertical plane.

* * * * *